US008970646B2

(12) United States Patent
Guncer

(10) Patent No.: US 8,970,646 B2
(45) Date of Patent: Mar. 3, 2015

(54) IMAGE CONSTRUCTION BASED VIDEO DISPLAY SYSTEM

(75) Inventor: Selim E. Guncer, San Diego, CA (US)

(73) Assignee: Ostendo Technologies, Inc., Carlsbad, CA (US)

( * ) Notice: Subject to any disclaimer, the term of this patent is extended or adjusted under 35 U.S.C. 154(b) by 1116 days.

(21) Appl. No.: 12/499,560

(22) Filed: Jul. 8, 2009

(65) Prior Publication Data

US 2010/0007804 A1 Jan. 14, 2010

Related U.S. Application Data

(60) Provisional application No. 61/079,418, filed on Jul. 9, 2008.

(51) Int. Cl.
*G09G 5/02* (2006.01)
*G09G 3/34* (2006.01)

(52) U.S. Cl.
CPC ..... *G09G 3/3426* (2013.01); *G09G 2340/02* (2013.01)
USPC ..... 345/694; 345/690; 345/87; 345/55

(58) Field of Classification Search
None
See application file for complete search history.

(56) References Cited

U.S. PATENT DOCUMENTS 5,452,024 A 9/1995 Sampsell
5,508,716 A 4/1996 Prince et al.
5,537,492 A * 7/1996 Nakajima et al. ..... 382/232
5,675,670 A 10/1997 Koide
5,696,524 A 12/1997 Hoshino et al.
6,111,560 A 8/2000 May
(Continued)

FOREIGN PATENT DOCUMENTS

CN 1322442 11/2001
CN 1348301 5/2002
(Continued)

OTHER PUBLICATIONS

"International Preliminary Examination Report of the International Preliminary Examination Authority Dated Apr. 14, 2011, International Application No. PCT/US2009/050175".
(Continued)

*Primary Examiner* — William Boddie
*Assistant Examiner* — Alecia D English
(74) *Attorney, Agent, or Firm* — Blakely Sokoloff Taylor & Zafman LLP

(57) ABSTRACT

A video display system based on constructing images through displaying orthogonal basis function components of the image is disclosed. The system is comprised of two display components aligned and driven concurrently. The first display component is a coarse pixel array. The second display component is a spatial light modulator whose geometric details are finer than the first pixel array. The overall system reconstructs the intended video to be displayed at the finer geometric details of the second display component at a minimal image quality loss through the use of time-domain display of orthogonal image basis function components. The resultant system has a considerably reduced interconnection complexity and number of active circuit elements, and also requires a considerably smaller video data rate if a lossy image reconstruction scheme is used. An embodiment with a LED based display and an LCD based spatial light modulator utilizing the concepts, and methods to drive the displays are described herein.

28 Claims, 10 Drawing Sheets

(56) References Cited

U.S. PATENT DOCUMENTS

| | | | |
|---|---|---|---|
| 6,229,583 | B1 | 5/2001 | Yasunishi |
| 6,477,279 | B2 | 11/2002 | Go |
| 6,535,195 | B1 | 3/2003 | Nelson |
| 6,850,219 | B2 | 2/2005 | Aoyama et al. |
| 7,623,560 | B2 | 11/2009 | El-Ghoroury et al. |
| 7,767,479 | B2 | 8/2010 | El-Ghoroury et al. |
| 7,829,902 | B2 | 11/2010 | El-Ghoroury et al. |
| 2002/0075217 | A1 | 6/2002 | Hoshino |
| 2005/0128172 | A1 | 6/2005 | Hoshino |
| 2006/0098879 | A1 | 5/2006 | Kim et al. |
| 2007/0035706 | A1 | 2/2007 | Margulis |
| 2007/0075923 | A1 | 4/2007 | Beuker et al. |
| 2008/0018624 | A1 | 1/2008 | Cernasov |
| 2008/0137990 | A1 | 6/2008 | Ward |
| 2009/0086170 | A1 | 4/2009 | El-Ghoroury et al. |
| 2009/0278998 | A1 | 11/2009 | El-Ghoroury et al. |
| 2010/0003777 | A1 | 1/2010 | El-Ghoroury et al. |
| 2010/0066921 | A1 | 3/2010 | El-Ghoroury et al. |
| 2010/0220042 | A1 | 9/2010 | El-Ghoroury et al. |

FOREIGN PATENT DOCUMENTS

| | | |
|---|---|---|
| CN | 1666241 | 9/2005 |
| EP | 0577258 | 1/1994 |
| EP | 0720141 | 7/1996 |
| JP | 51-056118 | 5/1976 |
| JP | 2001-350454 | 12/2001 |
| JP | 2005-532588 | 10/2005 |
| WO | WO-2004/006219 | 1/2004 |

OTHER PUBLICATIONS

"International Search Report and Written Opinion of the International Searching Authority Dated Sep. 9, 2009", International Application No. PCT/US2009/050175.

Shirai, T., et al., "RGB-LED Backlights for LCD-TVs with 0D, 1D, and 2D Adaptive Dimming", *2006 SID International Symposium, Society for Information Display*, SD 06 Digest, 44.4, (2006), pp. 1520-1523.

Poynton, Charles, "Digital Video and HDTV Algorithms and Interfaces", Morgan Kaufmann Publishers, an Imprint of Elsevier Science, (2003), pp. 447-454.

"International Search Report and Written Opinion of the International Searching Authority Dated Jun. 10, 2010", International Application No. PCT/US2010/026325.

"Office Action Dated Aug. 20, 2012, European Patent Application No. 10710122.2".

"Office Action Dated May 31, 2012, Korean Patent Application No. 10-2011-7002953".

Lueder, Ernst , "Liquid Crystal Displays, Addressing Schemes and Electro-Optical Effects", John Wiley & Sons Ltd., (2001), pp. 176-194.

"Notice of Allowance Dated Nov. 28, 2012, Korean Patent Application No. 10-2011-7002953".

"Office Action Dated Apr. 16, 2013; Japanese Patent Application No. 2011-517637".

"Office Action Dated Apr. 22, 2013; Chinese Patent Application No. 200980134961.9".

Office Action Dated May 28, 2013; U.S. Appl. No. 12/717,365.

"Office Action Dated Apr. 1, 2013, Korean Patent Application No. 10-2011-7023107".

"Office Action Dated Apr. 18, 2013; European Patent Application No. 10710122.2".

"Office Action Dated Mar. 4, 2013; European Patent Application No. 09790247.2".

"Office Action Dated Mar. 5, 2013, Japanese Patent Application No. 2011-553131".

"Office Action Dated Jul. 1, 2014; Chinese Patent Application No. 201080019853.X".

"Office Action Dated May 9, 2014; European Patent Application No. 10710122.2".

"Notice of Allowance Dated Nov. 26, 2013, Japanese Patent Application No. 2011-553131".

"Notice of Allowance Dated Oct. 1, 2013; Japanese Patent Application No. 2011-517637".

Notice of Allowance Dated Oct. 28, 2013; U.S. Appl. No. 12/717,365.

"Office Action Dated Dec. 2, 2013; Korean Patent Application No. 10-2011-7023107".

"Office Action Dated Nov. 25, 2013; European Patent Application No. 09790247.2".

"Office Action Dated Sep. 4, 2013; Chinese Patent Application No. 201080019853.X".

"Office Action Dated Apr. 5, 2014; Korean Patent Application No. 10-2011-7023107".

"Office Action Dated Jan. 8, 2014; Chinese Patent Application No. 200980134961.9".

"Notice of Allowance Dated Mar. 25, 2014; European Patent Application No. 09790247.2".

"Notice of Allowance Dated Oct. 10, 2014; Chinese Patent Application No. 201080019853.X".

"Office Action Dated Aug. 12, 2014; Chinese Patent Application No. 200980134961.9".

* cited by examiner

IMAGE CONSTRUCTION BASED VIDEO DISPLAY SYSTEM

CROSS-REFERENCE TO RELATED APPLICATION

This application claims the benefit of U.S. Provisional Patent Application No. 61/079,418 filed Jul. 9, 2008.

BACKGROUND OF THE INVENTION

1. Field of the Invention

This invention relates to image and video displays, more particularly flat panel displays used as still image and/or video monitors, and methods of generating and driving image and video data onto such display devices.

2. Prior Art

Flat panel displays such as plasma displays, liquid crystal displays (LCD), and light-emitting-diode (LED) displays generally use a pixel addressing scheme in which the pixels are addressed individually through column and row select signals. In general, for M by N pixels—or picture elements—arranged as M rows and N columns, there will be M row select lines and N data lines. When a particular row is selected, N data lines are powered up to the required pixel voltage or current to load the image information to the display element. In a general active-matrix type LCD embodiment, this information is a voltage stored in a capacitor unique to the particular pixel (see FIG. 1). When the row and column signals de-select the pixel, the image information is retained on the capacitor. In a passive-matrix type LCD embodiment, rows and columns are arranged as stripes of electrodes making up the top and bottom metal planes oriented in a perpendicular manner to each other (see FIG. 2). Single or multiple row and column lines are selected with the crossing point or points defining the pixels which have the instantaneous video information. In such a case, either the row or column signal will have a voltage applied which is proportional to the pixel information. In a light-emitting-diode display type embodiment, the information is an instantaneous current passing through the pixel LED which results in the emission of light proportional to the applied current. Both active and passive matrix driving of LED arrays can be made. In all these display types mentioned, the pixel resolution is equal to or less than the geometric dimensions of the pixels. For example, in a VGA resolution screen, we need to implement at least 640×400 individual pixels for each color component. The total information conveyed to the display arrangement per video frame is then given as M×N×3×bit-width, where the factor 3 comes from the three basic colors constituting the image, i.e. red, green and blue, and the bit-width is determined from the maximum resolution of the pixel value. Most common pixel value resolution used for commercial display systems is 8 bits per color. For example, for a VGA resolution display, the total information needed to convey will be 640×400×3×8 equal to 6 Mbits per frame of image, which is refreshed at a certain frame refresh rate. The frame refresh rate can be 24, 30, 50, 60, etc. frames per second (fps). The faster rate capability of the screen is generally used to eliminate motion blurring, in which rates of 120 or 240 fps implementations can be found in commercial devices. For a gray-scale image, the information content is less by a factor of three since only the luminance information is necessary.

Video and still images are generally converted to compressed forms for storage and transmission, such as MPEG4, H.264, JPEG2000 etc. formats and systems. Image compression methods are based on orthogonal function decomposition of the data, data redundancy, and certain sensitivity characteristics of the human eye to spatial features. Common image compression schemes involve the use of Direct Cosine Transform as in JPEG or motion JPEG, or Discrete Walsh Transform. A video decoder is used to convert the compressed image information, which is a series of orthogonal basis function coefficients, to row and column pixel information to produce the image information, which will be for example at 6 Mbits per frame as in VGA resolution displays. However, from an information content point of view, much of this video information is actually redundant as the image had originally been processed to a compressed form, or it has information content in the higher order spatial frequencies to which the human eye is not sensitive. All these techniques pertain to the display system's components in the software or digital processing domain, and the structure of the actual optical display comprised of M×N pixels is not altered by any of the techniques used for the video format, other than the number of pixels and frame rate.

Spatial Light Modulators (SLM) are devices which alter the amplitude or phase, or both of a transmitted or reflected light beam in two-dimensions, thereby encoding an image to an otherwise uniform light illumination. The image pixels can be written to the device through electrical, or optical addressing means. A simple form of a spatial light modulator is the motion picture film, in which images are encoded on a silver coated film through photo-chemical means. An LCD system is also a particular kind of SLM, such that each pixel's information is encoded through electrical means to a specific position, and the backlit light source's spatial profile, which in general is uniform over the whole display area, is altered by the transmissivity of the pixels.

Prior art in the field generally addresses a single component of the problem at hand. For example, image compression and decompression techniques have not been applied directly on the display element, but only in transmission, storage, and image reconditioning and preparation of data for the display (as in U.S. Pat. No. 6,477,279). Systems incorporating spatial light modulation in which pixels are turned on and off to transmit a backlight to have various degrees of modulation can be implemented (eg. Multiple row select as in U.S. Pat. No. 6,111,560), or both backlight and image modulation can be used to enhance the resolution of the image (as in U.S. Published Application Nos. 2007/0035706 and US 2008/0137990). In especially the latter applications and their relevant disclosures, none of the image construction methods incorporate a temporal dimension in synthesizing the image frame, which is the subject of this disclosure. Thereby both systems, representative of conventional methods of displaying images pixel by pixel on a frame by frame basis, do not benefit from the inherent simplification of the interface and data throughput—which is embedded into the image compression process with which the video is transmitted in.

BRIEF DESCRIPTION OF THE DRAWINGS

FIG. 2 depicts the pixel selection method employed in passive matrix LCD displays. There are M row select signals and N data signals. Signal timing determines which location will have an instantaneous voltage applied between the two electrodes, to which the liquid crystal molecules in between will react to.

Figure 1:
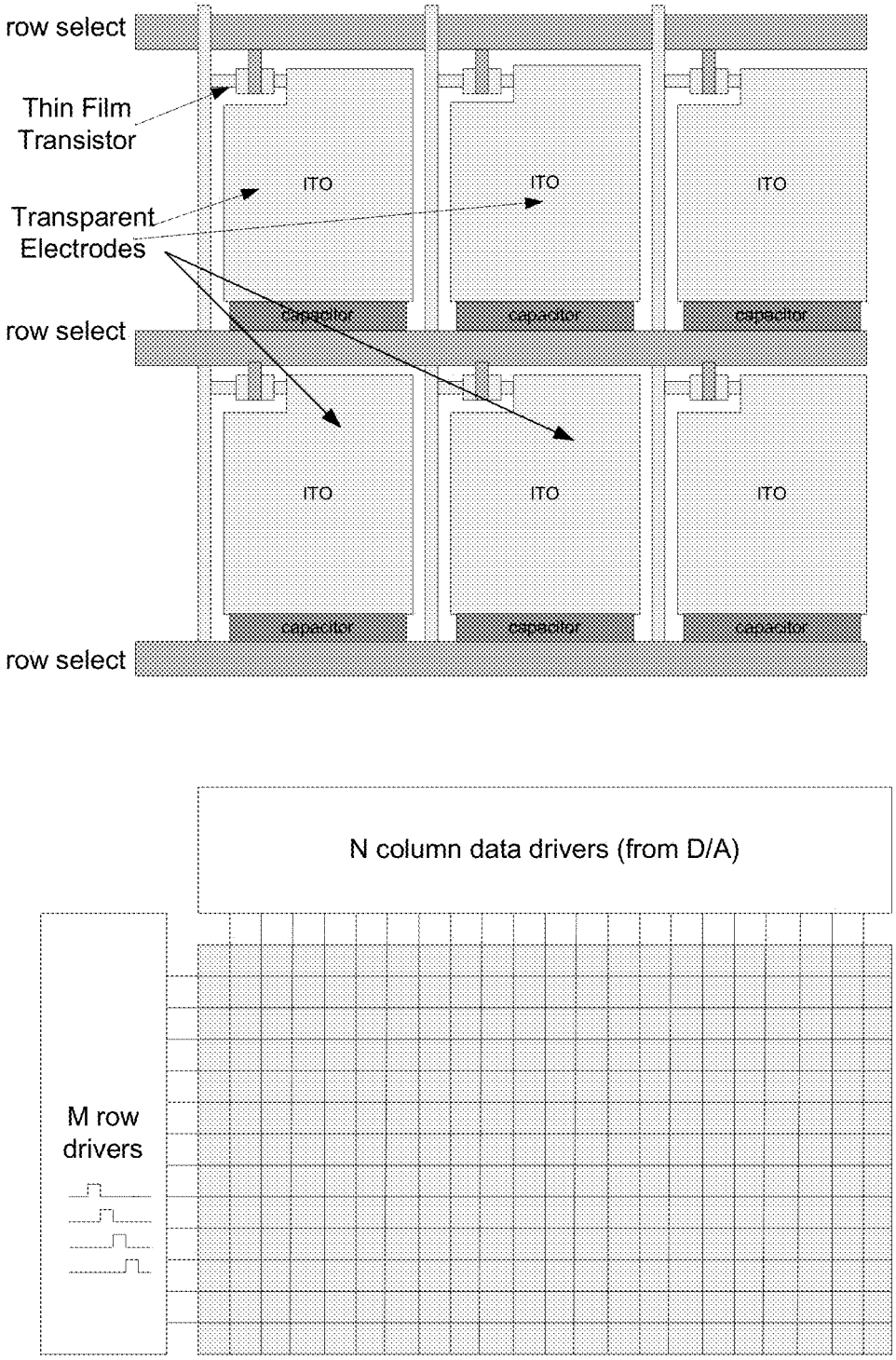
FIG. 1 depicts the pixel selection method used in active matrix flat panel displays, specifically an active matrix liquid crystal display. Each pixel is addressed through row and column select signals, with the video information applied through either one of the select signals. For an M×N pixel system, there are M row select signals, and N data lines. The data (video information) is generated by a Digital-Analog Converter, and the voltage is stored in a capacitor for each pixel. The voltage is applied to two parallel plates composed of a transparent electrode such as ITO (Indium Tungsten Oxide).
Figure 2:
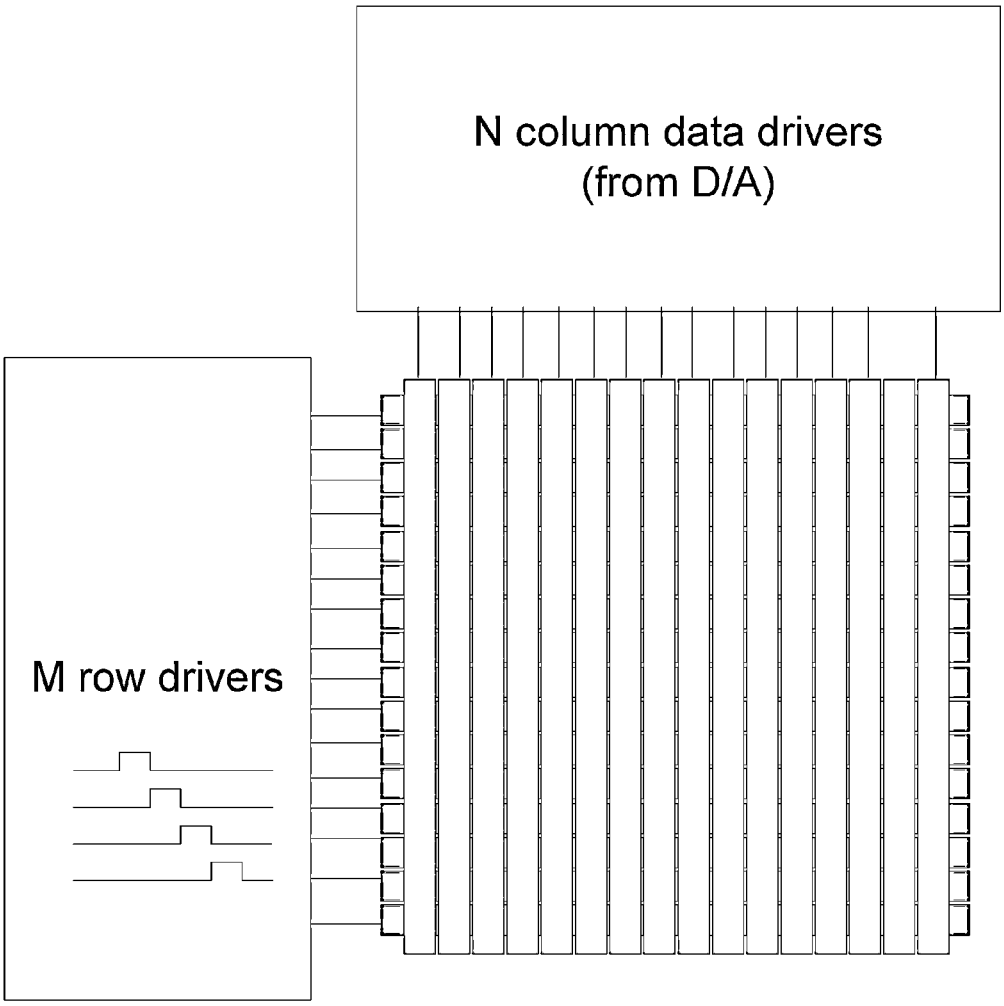

The present invention may have various modifications and alternative forms from the specific embodiments depicted in the drawings. These drawings do not limit the invention to the specific embodiments disclosed. The invention covers all modifications, improvements and alternative implementations which are claimed below.

DETAILED DESCRIPTION OF THE PREFERRED EMBODIMENTS

Figure 3:
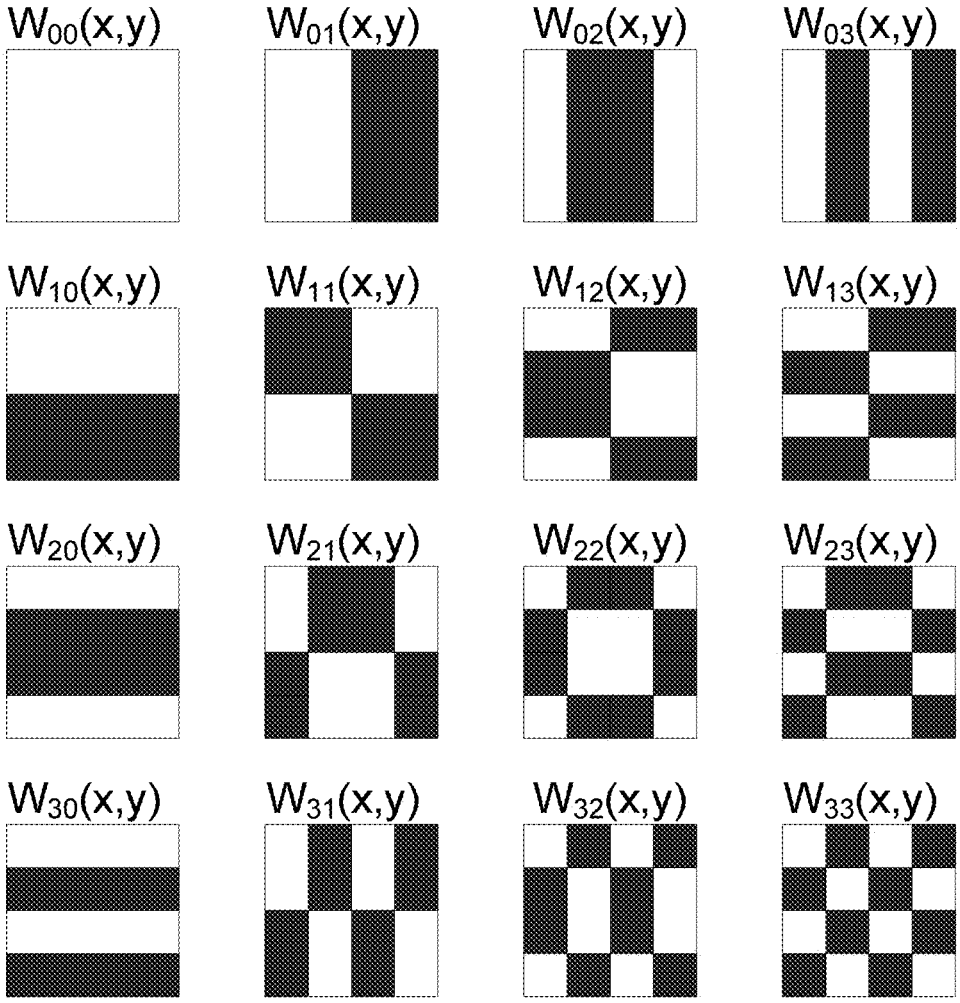
FIG. 3 shows the basis functions which the spatial light modulator will implement in the form of a mask pattern for a 4×4 pixel grouping.

An aspect of the invention is a display method and system which constructs an image and/or video through successively displaying a multiple of image components in subframes generated using a coarsely pixelated light array operating at a high frame rate, and a spatial light modulator, which produces certain patterns pertaining to orthogonal basis functions at the same frame rate with a resolution finer than the underlying light source. The image construction system takes advantage of using image compression components whereby the components are distributed in time domain by encoding video images using a spatial light modulator. In each frame, the source image to be driven is first grouped together to a certain size consisting of $n_x \times n_y$ pixels. For example, we can divide the image into rectangular groupings of 4×4 or 8×8 pixels, 4×1, 8×1, or any other arbitrary group size with the provision that we can generate orthogonal basis functions in one or two dimensions. The 1×1 case does not have any compression benefit, and corresponds to methods employed in conventional display systems. The grouping size is limited by the frame rate, which is limited by the switching speed of the components described herein and the image compression ratio. Each image grouping, or coarse pixel as will be referred from here on, is decomposed into components proportional to a series of said orthogonal image basis functions (orthogonal decomposition). These image functions are implemented in display hardware using spatial light modulators, which modulate the amplitude and/or phase of the underlying light, so that it has the desired spatial profile of the orthogonal image basis functions. The image basis functions are shown in FIG. 3 for 4×4 and FIG. 4 for 8×8 pixel groupings. The particular basis functions shown are also commonly known as Walsh functions. Other basis functions, such as Direct Cosine Transform basis functions can also be used for basis function patterns provided the spatial light modulator can produce cosine-shaped amplitude profiles. For 4×1 or 8×1 grouping, the basis functions are those in the first row of each figure. In these figures, the dark areas denote transmissivity of 0%, or blocking of light, and white areas denote a transmissivity of ideally 100%. Note that this definition differs from that used in image compression techniques in that the basis functions have the values of −1 or +1, as opposed to 0 or +1. A method to correct for this difference is described herein. For the first grouping of 4×4 pixels, there are 16 basis functions, while for the latter grouping of 8×8 pixels, there are 64 basis functions. Denote the basis functions as $w_{uv}(x,y)$ where u and v are the basis function indices and x, y are rectangular coordinates spanning the area of the pixel grouping dimensions. Denote $f_c(x,y)$ as the two dimensional image information for a color component. Here, the superscript c denotes the color red, green or blue (the primary colors). The method is identical for gray-scale images, in which case f(x,y) would be proportional to the luminance of the image. Fast masking of coarse pixel areas using a spatial light modulator can also be used for lossless image construction as demonstrated in FIG. 5, which will be less efficient from a data rate point of view, and have tighter constraints on spatial light modulator switching speeds than compression based methods. In such a case, since only one pixel out of the coarse pixel grouping is transmitted through the masking pattern, the power efficiency of the implementation is very low. For a 2×2 pixel grouping, the maximum average transmissivity is 25%, and much smaller for 4×4 and 8×8 groupings since one pixel is transmitted out of 16 and 64 pixels in the coarse pixel at one time. For the image decomposition based scheme, the transmitted light is blocked in half the pixels for non-zero spatial components of $D_{uv}$, which are small compared to $D_{00}$. The average transmissivity value of the pixels is always greater than 75% (not taking into account other implementation losses such as the polarizer loss).

Figure 4:
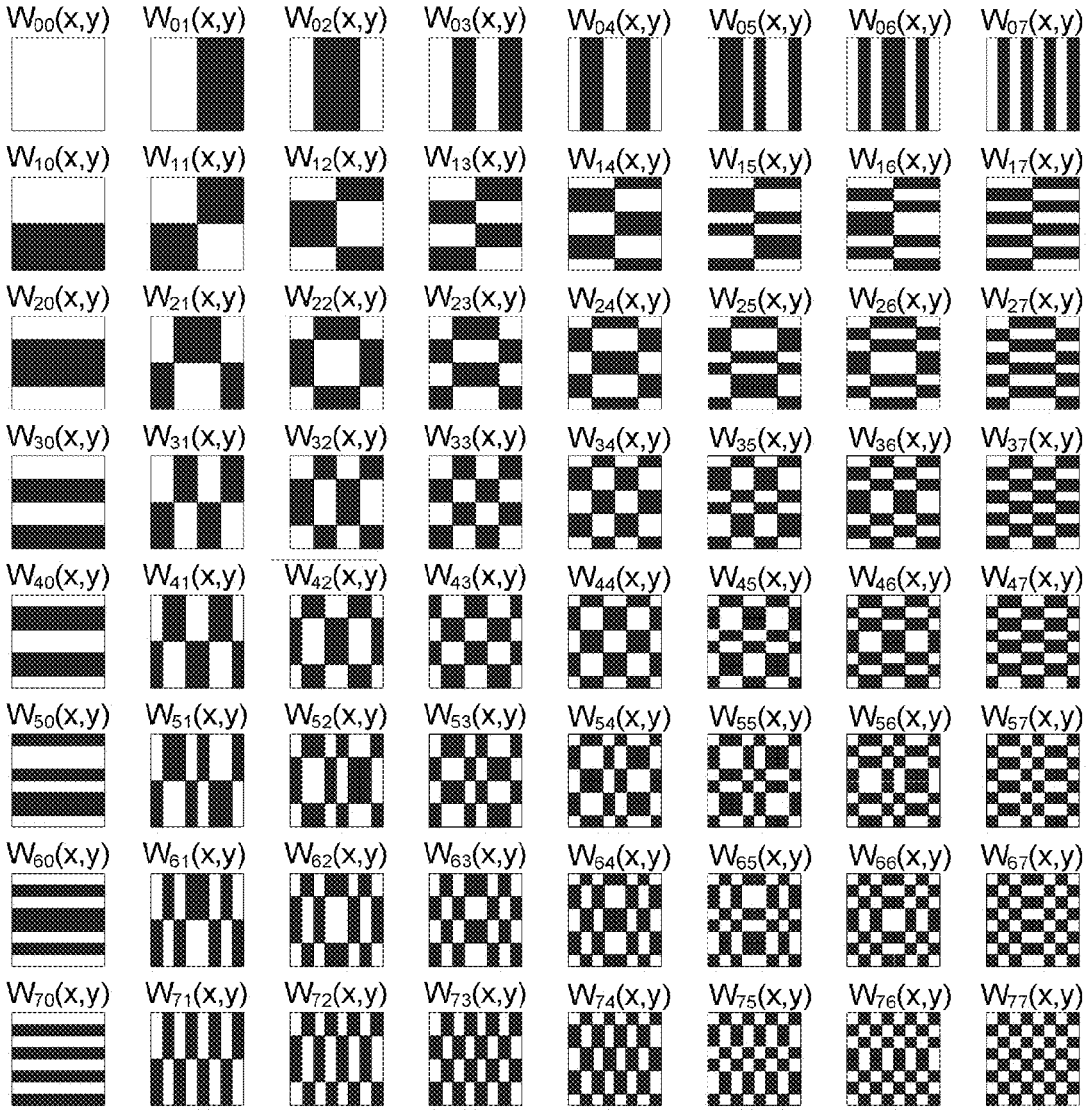
FIG. 4 shows the basis functions which the spatial light modulator will implement in the form of a mask pattern for a 8×8 pixel grouping.
Figure 5:
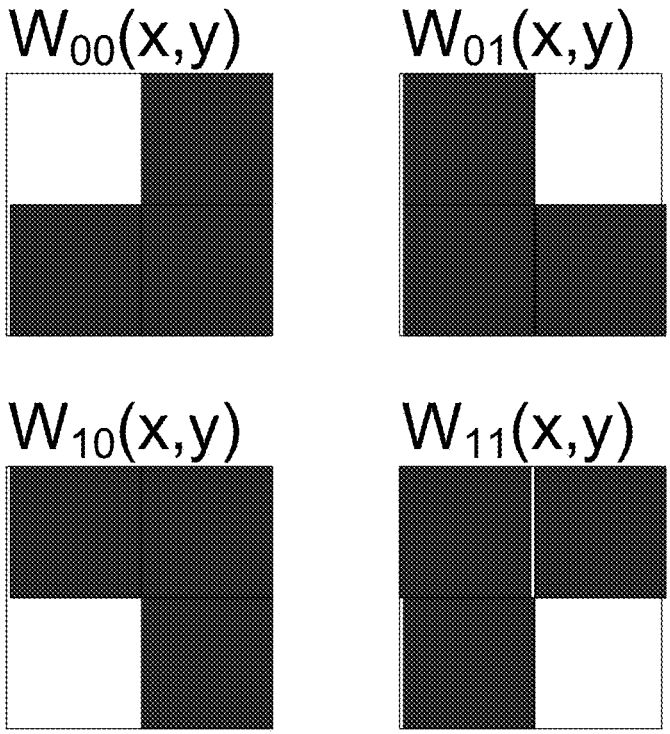
FIG. 5 shows the masking pattern for a 2×2 pixel grouping in which data compression is not used. The light efficiency is reduced by a factor of 4 since one pixel is turned on at one time.

Any image can be decomposed into components, which are found by integrating the image data with the basis functions like those shown in FIG. 3 and FIG. 4. The top-left function in both figures is a uniform. function, $w_{00}$. As we progress towards the right, the functions will vary in the horizontal direction, having a faster variation with a higher index number "0v". The higher index pertains to the image function having higher spatial frequencies. Similarly, the variation of the basis functions in the vertical direction is described by vertical spatial frequency components having indices "u0". The other basis function components can be diagonal components, such as $w_{ii}$ and off-diagonal components $w_{,ij}$ where i and j are non-zero and different. For a video pixel array, which is a spatially discrete function, this integration is in the form of summation. Denote the image component as $D^c_{uv}$ where u and v are the basis function indices in two dimensions, and c denotes the color component: red, green or blue. Then $D^c_{uv}$ are determined from:

$$D^c_{uv} = \sum_{x=0}^{n_x-1} \sum_{y=0}^{n_y-1} f^c(x, y) * w_{uv}(x, y) \quad \text{EQ. 1}$$

The invention is based on the inverse transform of EQ. 1, i.e. that an image $f^c$ (x,y) can be constructed as a summation of $D^c_{uv}*w_{uv}$.

$$f^c(x, y) = \sum_{u=0}^{n_x-1} \sum_{v=0}^{n_y-1} D^c_{uv} * w_{uv}(x, y) \quad \text{EQ. 2}$$

The summation is effectively perceived by the human eye in time domain through successively displaying patterns corresponding to the basis functions $w_{uv}$ with a light strength proportional to $D^c_{uv}$. The human eye would integrate the image patterns and perceive a single image corresponding to $f^c$ (x,y).

In orthogonal function implementations used in conventional compression techniques, the basis functions $w_{uv}(x,y)$ take on values of +1 or −1, thereby satisfying orthogonality properties. In this invention, the value of the basis functions are mapped to +1 or 0 instead since we use these functions in the display directly. This creates a non-zero integration component (which is equivalent to the average value of the image $D^c_{uv}*w_{uv}$). This component is kept track of, and subtracted from the $D^c_{00}$ component, where $D^c_{00}$ is the sum of the image over the pixel grouping, or equivalently, the average of the image over the pixel grouping, normalized to $1/(n_x n_y)$ $$D^c_{00} = \sum_{x=0}^{n_x-1} \sum_{y=0}^{n_y-1} f^c(x, y)$$

$D^c_{00}$ is also proportional to the light intensity of a single 'pixel' (which is the equivalent of a coarse pixel in the definition used herein) if we intend to display the image using the coarsely pixelated display source.

In most cases, $D^c_{00}$ is greater than or equal to the sum of the rest of the image components derived using the +1 and 0 mapping. Hence, subtracting out each of these non-zero integration components from $D^c_{00}$ will be greater than or equal to zero. —Consider for example the $D^c_{01}$ component. Denote $w_{uv}(x,y)$ as the original Walsh function having the values of +1 and −1. Using the new basis functions, $w^*_{uv}(x,y) = (w_{uv}(x,y)+1)/2$, substituting $w_{uv}(x,y)$ which can take on values of 0 and 1 instead of −1 and +1, $w^*_{uv}(x,y)$ will transform the image construction equation EQ.2 to $$f^c(x, y) = \sum_{u=0}^{n_x-1} \sum_{v=0}^{n_y-1} D^c_{uv} * 2 * w^*_{uv}(x, y) - \sum_{u=0}^{n_x-1} \sum_{v=0}^{n_y-1} D^c_{uv} \quad \text{EQ. 3}$$

To reproduce the image correctly, the component value to be displayed when the basis function is equal to all 1's ($w_{00}$) has to be corrected with one half the summation over all $D^c_{uv}$ as in the second term of EQ. 3. Note that if a subset of basis functions are used as in compression, the summation should span only the $D^c_{uv}$ image components that are used. The updated $D^c_{00}$ component is used in the image construction instead of the original value, since now the total sum of the average components will equal the original $D^c_{00}$ value.

The image components $D^c_{uv}$ can have positive or negative values. In implementing the display component, the value of $D^c_{uv}*w^*_{uv}(x,y)$ can only be positive. In the case of 'negative' $D^c_{uv}$, the image component is generated using the absolute value of $D^c_{uv}$ and the inverse of the basis function pattern $w^*_{uv}(x,y)$. The inverse of the function is defined as the two's complement of the binary function $w^*_{uv}(x,y)$ in which 0's are mapped to 1's and vice versa.

Figure 6:
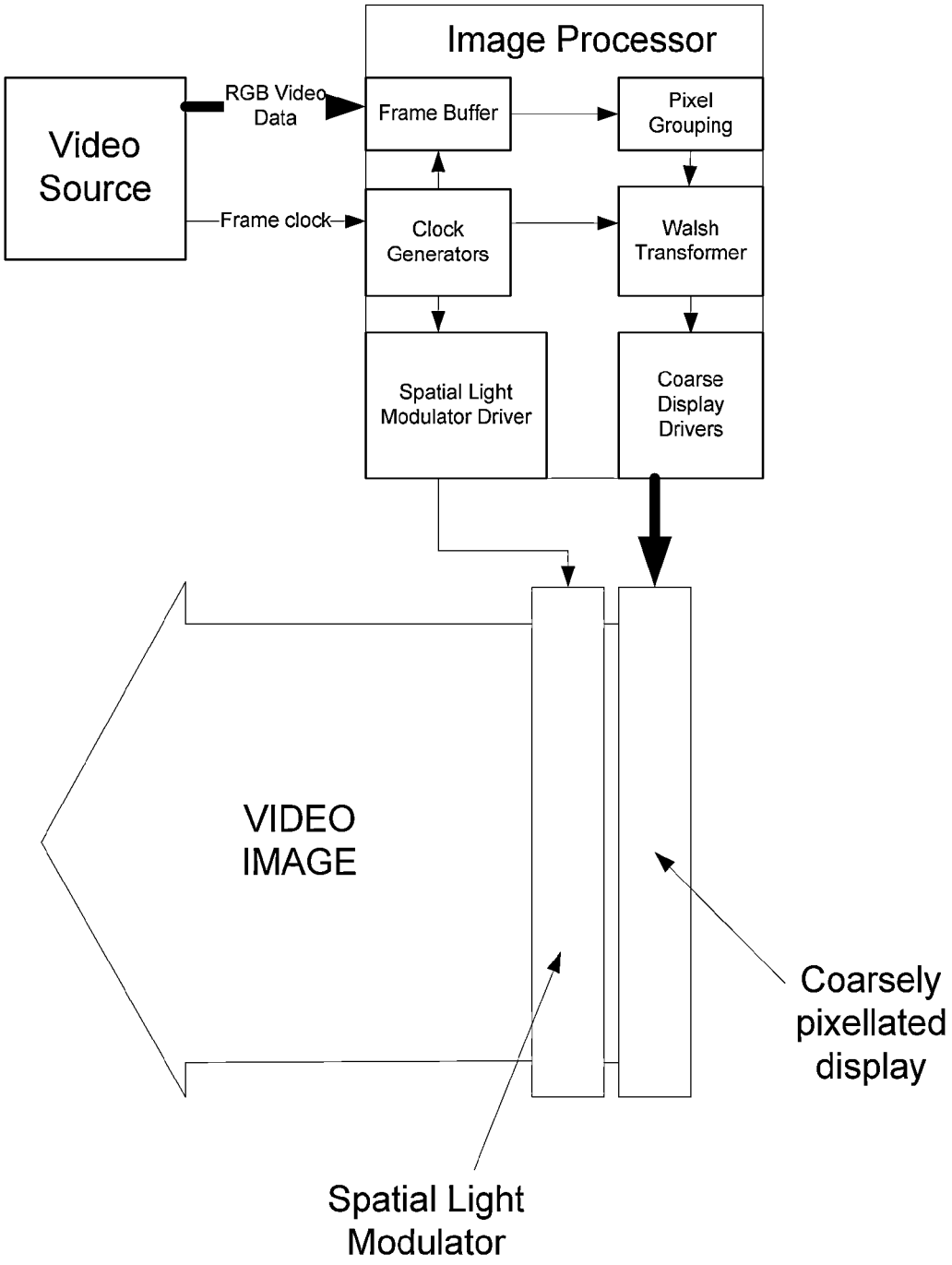
FIG. 6 shows the block diagram of the video display system employing a coarsely pixelated video source, a spatial light modulator, computation device for image processing, timing generator blocks.

A block diagram showing the whole system is shown in FIG. 6.

For each frame the video image is constructed through:

1. Calculating the image component strength $D^c_{uv}$ related to the image $f^c$ (x,y) for each coarse pixel, for each uv component, and for each color.
2. Applying a light intensity mask through the use of a spatial light modulator corresponding to $w^*_{uv}(x,y)$.
3. Applying a light proportional to $D_{uv}$ for each coarse pixel. For color displays, three color light elements are used per pixel grouping. The light intensities of the red, green and blue sources are adjusted according to the calculated $D^c_{uv}$ for each color. The light intensities may be adjusted by adjustment of at least one of a voltage, a current and/or the perceived intensity adjusted by the on time of the light source, depending on what light source is used. The $D^c_{uv}$ image components can actually take positive or negative values. In the case of a negative image component, the light intensity is the absolute value of the image component, but in the reconstruction of the image, we use the inverse of the masking pattern.

To arrive at a single frame of the intended image, each image component, which can be defined as a subframe, is displayed sequentially. An observer's eye will integrate the flashed image components to visually perceive the intended image, which is the sum of all flashed image components. Each displayed component, or subframe, duration can be made equal, or the duration can be optimized for bit resolution. The latter case enables one to optimize the spatial light modulator's shutter speed, such that a longer image component duration is allocated to image components which require a higher bit precision, versus shorter image component durations which do not necessarily have to settle to a finer precision. In such a case, when $D^c_{uv}$ components are flashed for shorter durations of time with respect to other components, the light intensity will have to be increased by the same time reduction ratio.

For color images, the red, green and blue light sources can be shined proportional to their respective $D^c_{uv}$ values concurrently, or time-sequentially. In the time-sequential case, where red, green and blue images are flashed separately, the SLM shutter speeds have to be three times faster than the concurrent case. In the concurrent case, one can have either all component values having the same sign, or one of the component values having opposite sign than the other two. For any coarse pixel, we may need both $w_{uv}$ and its inverse pattern to be displayed, since each color component may not necessarily have the same sign. Therefore, the SLM will generate all basis functions, and their inverses for each subframe. If there is no component for the inverse basis function, then the coarse pixel value to be displayed will be equal to zero.

In general, the SLM control will span ideally the whole display, or may be subdivided into smaller sections, so it is expected that both $w^*_{uv}$ and its inverse patterns will be required. If the SLM is controlled over each coarse pixel, at the expense of a more complex switching and driving scheme, subframes for unused basis functions need not be included.

Image compression can be either a lossless transformation or a lossy transformation. In lossless transformation, we can construct the image with no fidelity loss from the available image components. In a lossy compression based decomposition, one will neglect certain components, such that, when we construct the image with the unneglected components, the image quality may suffer. In most video and still images, lossy compression is employed to reduce size of the data. In lossy compression, one will usually neglect image components which are below a certain threshold, and image components which the human eyes have reduced sensitivity to. These are generally terms with high order spatial frequencies pertaining to diagonal and off-diagonal tennis. Compression will basically try to describe the image with as few terms as possible, for a given image error bound. In most cases, the terms which are dropped first will be off-diagonal components, followed by diagonal terms, from higher order terms down to lower order terms. Taking the example of 4×4 pixel grouping, which will have 16 image components from $D_{00}$, $D_{01}$, $D_{02}$, $D_{03}$, $D_{10}$, $D_{11}$, etc. up to $D_{33}$, using the basis functions $w^*_{00}$ through $w^*_{33}$, and the inverses of these components (except for $w_{00}$), the original image will be exactly reconstructed if we use all 31 components. In video compression, most images will have the oblique spatial components neglected. A display system which uses only horizontal and vertical image components can be satisfactory in some cases. To improve image accuracy, diagonal spatial frequency components such as $D_{11}$, $D_{22}$ and/or $D_{33}$ can also be added. The oblique components such as $D_{12}$, $D_{13}$, $D_{23}$ etc. may be neglected. In a majority of video sources which use for example MPEG compression, such components have actually been largely eliminated altogether for compressing the video itself for storage and transmission, or turn out to be smaller than a particular threshold which we would deem to be negligible. When image components are neglected, the frame time may be re-proportioned by extending the subframe time for at least one other image component. Even without doing so, a data reduction is achieved. If none of the components are non-negligible, we may resort to lossless operation on the coarse pixel by considering all components. Note also that, in certain embodiments, we can implement a method in which the SLM over a particular coarse pixel can operate independently from other regions. In such a case different coarse pixels can have different levels of compression, from highly compressed to lossless compression. This can be determined from the source video at the same time. Such a case can occur for example in a computer monitor, where during operation, regions of the screen may be stagnant, but require a high accuracy such as a window showing a text and still images, or portions having a fast moving image in which we need a high frame rate to describe the motion more accurately, but not necessarily need a lossless image reproduction scheme. By running the SLM at different rates on different coarse pixels, the image accuracy and power can be optimized. We can decide on which coarse pixel to run which accuracy mode by calculating the $D_{uv}$ components, determining how many are non-negligible, and comparing them to the components in the earlier image frames. A fast moving image vs. slow or stagnant image, and an accurate image vs. a lossy compressed image can be differentiated thus.

Taking the example of a VGA resolution display operating at 30 frames per second, and a 4×4 pixel grouping to define the coarse pixels, the display device to satisfy VGA resolution employing this invention can use 1. 160×100 coarse pixel array whose pixel dimensions are four times larger horizontally and vertically than the intended resolution, and having red, green and blue light elements.

2. A SLM composed of a passive matrix LCD which generates vertical, horizontal and an oblique basis function pattern using horizontal stripes of transparent electrodes in the bottom plane and vertical stripes of transparent electrodes in the top plane of the LCD, or vice versa—such an SLM is capable of generating the sixteen orthogonal basis patterns and their inverses. The electrode widths are equal to the intended pixel resolution size. A total of 640 vertical electrodes and 400 horizontal electrodes exist in the SLM (which may be broken into a multitude of pieces along each direction for faster driving).

3. A computation device which calculates the corresponding $D_{uv}$ components for each color from a VGA resolution image at each frame.

4. Driving the SLM pattern with the macro coarse pixel intensity proportional to $D_{uv}$, for all non negligible image components. For a compressed video source, using the first 7 or 8 dominant image components will in general be sufficient to reproduce compressed video. This will require the generation of 13 or 15 basis function patterns (out of 31) including the inverse patterns.

5. Other elements may be necessary for light quality, such as a light collimator or diffuser to mix red, green and blue light outputs to produce a uniform light source over the coarse pixel area.

The number of active pixels is reduced from 768000 (for three colors) by a factor of 16 down to 48000 (for three colors). There are 16000 coarse pixels in the display. The raw image data rate depends on the level of image compression desired. For a lossless image reconstruction, there are 16 $D_{uv}$ components per coarse pixel per color. If each Duv is described with 8 bit accuracy, we need 184 Mbps data rate. This corresponds to 128 bits per coarse pixel per color per frame. In reality, only the $D_{00}$ component needs to have 8 bit accuracy, while the higher order components can have less accuracy. Such component based accuracy assignment is commonly known as a quantization matrix in image compression. In a particular embodiment, one would not need more than 80 bits per coarse pixel per color per frame, which optimizes the data rate down to 120 Mbps. If a medium compression level is used in which we cut off oblique spatial frequency components such as $D_{12}$, $D_{13}$, $D_{23}$ etc. but not $D_{11}$, $D_{22}$, $D_{33}$, we are working with 10 components in total. These components would require a total of 60 bits per coarse pixel per color per frame. The total data rate is reduced to 86 Mbps. For a high compression ratio in which we neglect $D_{11}$, $D_{22}$, $D_{33}$, we would use 46 bits per coarse pixel per color per frame. The total data rate is then 66 Mbps. The SLM pattern needs to be updated 31 times each frame for the lossless compression case, 19 times each frame for the medium level compression case, and 13 times each frame for the high level compression case. The coarse display needs to be updated 8 to 15 times each frame, and will be blank (black) for unused SLM patterns. For 30 frames per second, flashing 13 subframes (for 7 components) results in 390 patterns to be generated per second, or roughly 2.5 msec per subframe. Using 19 subframes for 10 components, we would need to generate 570 SLM patterns per second, or 1.7 msec per subframe. For lossless image reproduction, a total of 31 subframes are needed, which equals 930 patterns per second, requiring 1.1 msec per subframe. The settling speed of conventional LCD's can be made sufficiently fast to be used as spatial light modulators which have only on-off (or black to white) transitions at such speeds by using fast enough liquid crystal material in a smaller geometry. A method to optimize subframe duration for different patterns reflecting the accuracy requirements from the quantization matrix can also be implemented.

Figure 7:
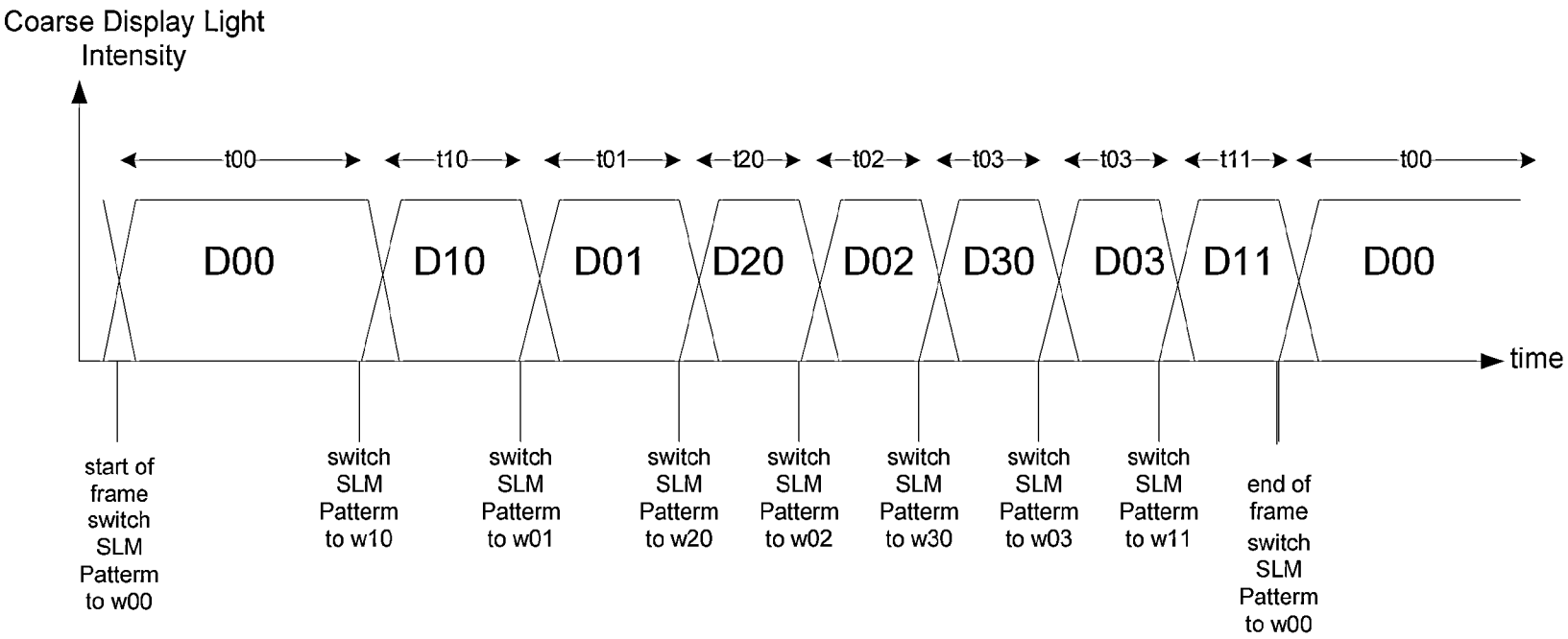
FIG. 7 shows the time slot optimization method used for coarse display types which have long switching speeds such as active matrix LCD displays. Reflecting a quantization matrix which determines the bit accuracy of components, each respective time slot allocation can be made proportional to the required precision so that a larger time slot is allocated to the $D_{00}$ component which requires the highest precision, and smaller time slots are allocated to other components.

For a liquid crystal based SLM, the settling time can be modeled using the liquid crystal materials switching time, and the response time of the voltage applied to a metal line of certain capacitance and resistance. If we have an exponential relationship arising the time constant due to the metal line, when we apply an instantaneous step voltage, the response will be of the form $$V(t)=V(0).(1-\exp(-t/\tau))$$

where $\tau$ is the R.C time constant. Therefore to get an 8-bit accurate voltage applied to the SLM, the minimum time required can be found by taking the natural logarithm of $1/2^8$, or $5.5\tau$. When a 6 bit accurate voltage is sufficient, the time required reduces to $4.15\tau$, and reduces further to $2.7\tau$ for 4 bit accurate voltages. Therefore, in a particular quantization matrix which employs 6-8 bit accuracy for the low order component terms, and down to 4 bits for high order components, we can allocate down to half the time for the highest order terms which require less accuracy compared to the most significant terms. As illustrated in FIG. 7, given that we have a fixed frame period, by allocating less time to these lower accuracy subframes we can either squeeze in more subframes within a frame duration, or allocate more slot time to the higher accuracy sub frames.

The SLM consists of vertical and horizontal electrodes which can span throughout the display. In this case, only 8 drivers, driven by a clock generator is sufficient to generate all patterns which are applied onto coarse pixels. However, for long electrodes, the capacitance of the electrodes may start posing a time-constant limit in addition to the liquid crystal time constant. To speed up the SLM, the electrodes may be broken into smaller pieces, each driven by its dedicated driver or buffers conveying the driver's information, serving a smaller area of the display.

In summary, a video display system which employs image compression techniques based on orthogonal basis function decomposition is disclosed. The system requires a much smaller number of active pixels than a conventional approach, since the image is constructed using coarse pixels, or coarse blocks, which are in essence highly coarse pixelations of the display. The number of rows and columns of the active pixel display is reduced accordingly, hence the interface is simplified. A spatial light modulator operating off a clock generating system is coupled to the active matrix display, such that we do not need to externally supply further data for this system, except to synchronize the images on the active pixel array. Since images are formed using orthogonal image components, a decompression scheme is in effect in which we can truncate the number of components to be used in reconstructing the image in order to reduce the data requirement of the display. The display can be made to generate a lossy decompressed image by truncating image components, or in effect perform a lossless regeneration of a compressed video input. In a particular mode of operation, the display may also regenerate lossless video by displaying all possible orthogonal components.

Figure 8:
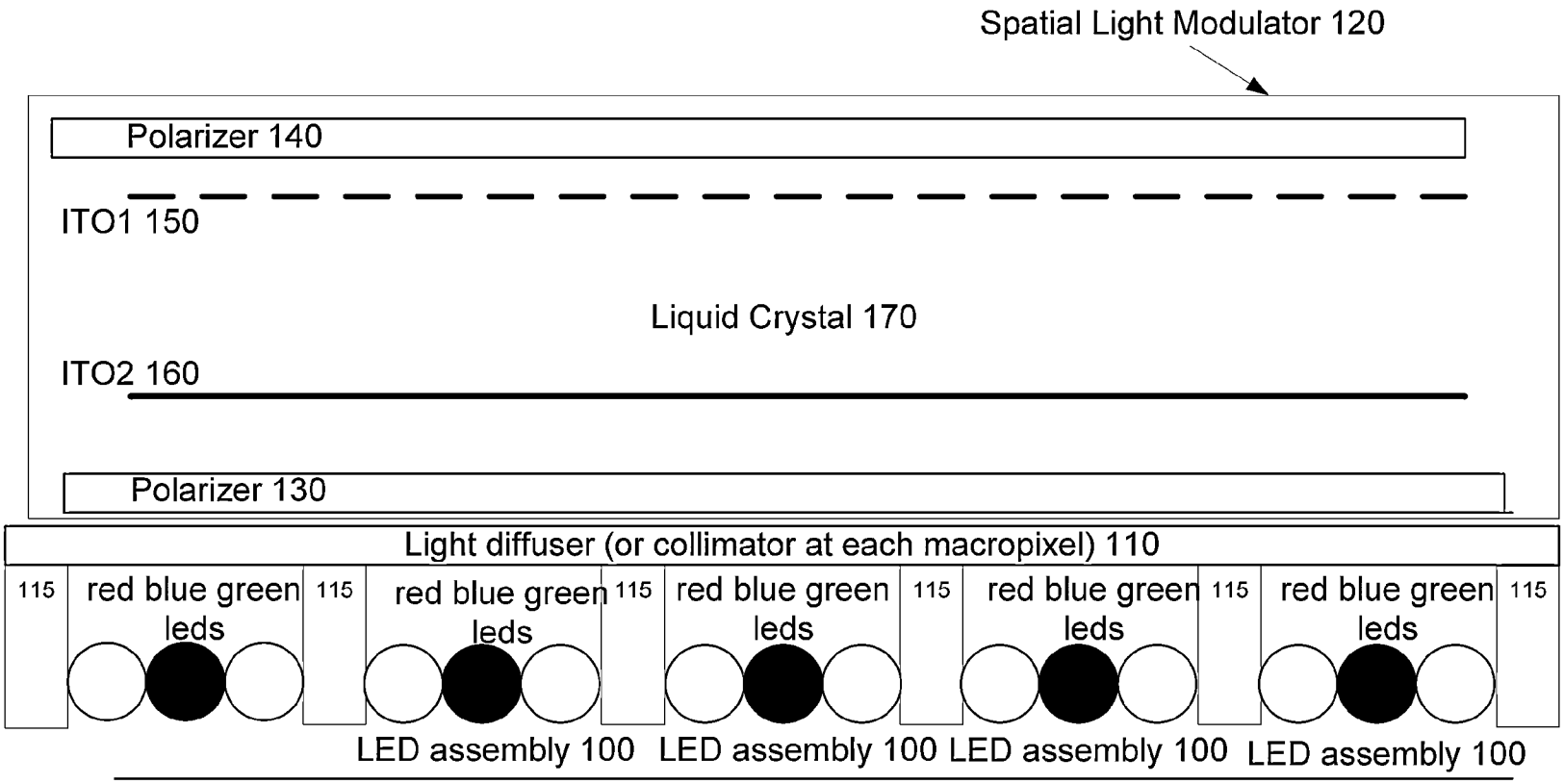
FIG. 8 shows the details of the display system using LED array as light source, passive matrix LCD as the SLM.
Figure 9:
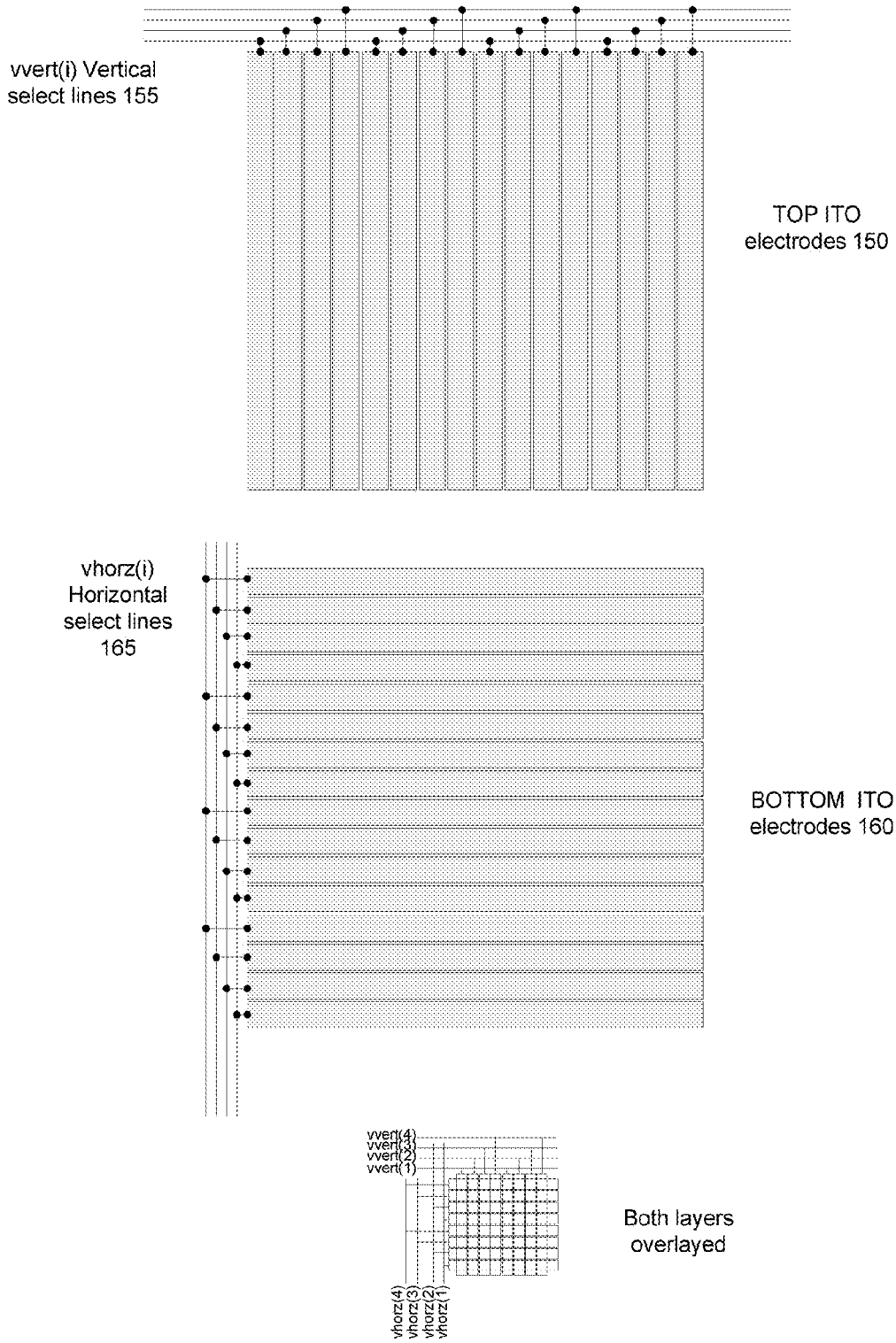
FIG. 9 shows the details of operation of the passive matrix LCD used as the spatial light modulator for 4×4 pixel groupings. The top transparent electrode (e.g., ITO) layer 150 is driven by 4 select lines vvert(i) 155, and the bottom ITO layer 160 is driven by four select lines vhorz(i) 165. To implement different basis functions $w_{00}$ through $w_{33}$, different voltages are applied to 155 and 165.
Figure 10:
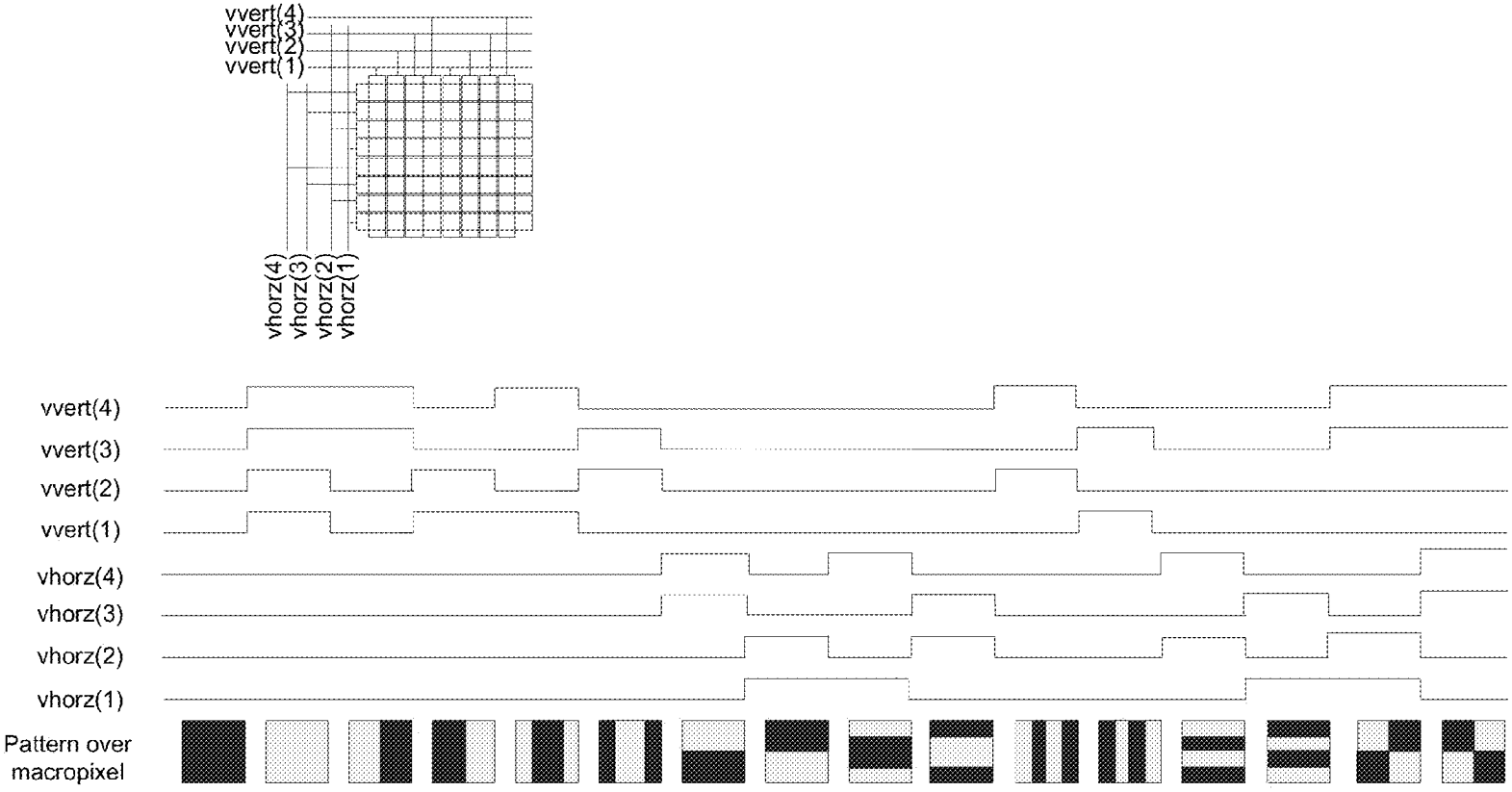
FIG. 10 shows the voltage waveforms applied to the passive matrix LCD used as the spatial light modulator for 4×4 pixel groupings, and the corresponding spatial basis function $w_{ij}$. For each subsequent frame, the voltage patterns may be the inverse of the previous frame.

In a particular embodiment of the invention, a LED based (solid state light source) display system is coupled to a liquid crystal spatial light modulator (see FIG. 9). The dimensions of the display system, and the resolutions are given as examples and to clarify the geometric aspects of the system. The display system is composed of a LED array of 160×100 red, green and blue light generating LEDs 100, totaling 48000 active elements. Each red, green and blue LED defines a coarse pixel, thereby 16000 coarse pixels exist. The coarse pixel dimension is taken as 2 mm×2 mm, corresponding to a display size of 32 cm ×20 cm. To form uniform light, a light diffuser or collimating lens layer 110 (FIG. 8) is used on top of the LED 100 layer. A black matrix pattern 115, which is commonly used in active matrix displays to isolate pixels to prevent crosstalk is used between the coarse pixels which house the red, green and blue LEDs 100. The spatial light modulator 120 is built using a passive matrix implementation of a LCD which is composed of two cross polarizers 130 140, and within the LCD, two parallel planes of transparent electrodes 150 160 which are perpendicular to each other (see FIG. 10). The electrode widths are 0.48 mm each, thereby four side by side electrodes occupy the same width as the coarse pixel. The length of the electrodes can span up to several coarse pixels of length, being limited by the switching speed of the LCD due to the capacitance of the electrodes. The volume of the LCD between the electrodes 150 160 is filled with liquid crystal material 170. The electrodes are manufactured from transparent conductive material such as InTnO, and have feature sizes equal to the intended resolution. Each of the eight electrodes in a coarse pixel, four on the top plate, four on the bottom plate, can be individually selected. The basis image patterns are generated by applying voltages to these electrodes. The necessary voltage waveforms are such that the electric fields tilt the liquid crystals maximum angle which causes the light to rotate its polarization to near 90 degrees for maximum transmission between cross polarizers 130 140. The applied voltage may have both positive and negative polarities in order to erase out the memory effect seen in liquid crystals, which will otherwise cause time-dependent degradation. A VGA resolution video source 180 is used to generate the raw video images, which has a native resolution of 640×400 pixels. A processing device 190 is used to generate the necessary driving image components for the 160×100 macro coarse pixels. For a frame rate of 30 fps, each color image is allocated a maximum of roughly 33 msec time, since we can process red, green and blue colors concurrently. For a 1 msec switching speed of on-off transitions in an LCD spatial light modulator, we can easily squeeze in enough image components for lossless reproduction. For each coarse pixel, the image decomposition algorithm determines the image components corresponding to each orthogonal basis function for each color to be used. The decomposition image components $D_{uv}$ where u and v run from 0 through 3 are calculated. These image components are summations of 16 pixel values comprising the coarse pixel according to the corresponding masking patterns $w_{uv}$. The number of decomposition image components to be used can be selected from 1-8 for a compressed source, in which high order image components will turn out to be zero, to the full set of 16 image components for lossless reconstruction of the image. Portions of the display can also have different compression levels during operation, which the image processor can decide depending on the decomposition image component value it calculates. The spatial light modulator 120 patterns are driven through a counter based logic which sequences the patterns $w_{00}$, $w_{01}$, $w_{02}$, $w_{03}$, $w_{10}$, $w_{20}$, $w_{30}$, $w_{11}$, $w_{22}$, $w_{33}$, $w_{12}$, $w_{21}$, $w_{13}$, $w_{31}$, $w_{23}$, $w_{32}$. The counter may reset at any point if the decomposition image components are negligible for higher order terms, thereby reducing the data rate, and improving the accuracy of the lower order terms by allocating more time. If necessary, to reduce flickering effects, the $w_{00}$ pattern may be divided into several subframes and interdispersed in the pattern sequence along with the corresponding component strength $D^c_{uv}$ normalized appropriately. This would be at the expense of a shorter subframe pattern duration.

What is claimed is:

1. A video system comprised of:

a video display having an array of M×N coarse pixels in which each coarse pixel is comprised of a set of primary color light sources for color operation, or a white light source for gray-scale operation, wherein the intensity of each light source is controllable;

a spatial light modulator aligned with the array of M×N coarse pixels to generate spatial masking patterns for blocking or passing light, the spatial masking patterns having a resolution finer than the coarse pixel sizes by a factor of p;

an image processor coupled to receive video image information to be displayed, the image processor being configured so that, for each video image, the following is carried out:

generating, for each coarse pixel and for each color to be displayed, a sequence of Walsh orthogonal function image components ($D^c$uv), each Walsh orthogonal function only having a value of −1 or +1, each image component being determined from the video image information ($f^c(x,y)$) and a corresponding masking pattern of the sequence of masking patterns corresponding to the Walsh orthogonal function image components ($D^c$uv), where u and v are indices for the basis functions and x and y are the coordinates of the video image pixels, for any image components other than $D^c_{00}$ that are negative, using the absolute value of the image component and using the inverse of the corresponding masking pattern;

correcting the $D^c_{00}$ image component by subtracting one half the summation of $D^c_{uv}$ over all $D^c_{uv}$, controlling the spatial light modulator to generate a sequence of spatial masking patterns for each coarse pixel, and providing driving information for the light source or light sources for each color to be displayed in each of the M×N coarse pixels corresponding to the sequence of image components ($D^c_{uv}$) for the respective color, so that the light source or light sources is/are driven with the light strength proportional to an image component ($D^c_{uv}$)while the corresponding masking pattern is illuminated;

whereby the video system can display video images at a resolution up to p times finer than the M×N coarse pixels.

2. The video system of claim 1 wherein the light sources are primary color solid state light sources.

3. The video system of claim 2 wherein the primary color solid state light sources are red, green and blue LED light sources.

4. The video system of claim 1 wherein the spatial light modulator is an active or passive matrix liquid crystal spatial light modulator.

5. The video system of claim 1 wherein the spatial light modulator is configured to simultaneously generate the same spatial masking patterns for all coarse pixels.

6. The video system of claim 1 wherein the spatial light modulator is configured to simultaneously generate the same spatial masking patterns for an array of multiple coarse pixels, the array of multiple coarse pixels being a sub-array of the array of M×N coarse pixels, whereby timing of the spatial masking patterns will be simultaneous for each coarse pixel within any one sub-array, but the timing of patterns within different sub-arrays is different.

7. The video system of claim 6 in which the number of image components to be used to reproduce an image for any given coarse pixel on the display is dynamically determined in the image processor through the use of certain thresholds below which the component is discarded when displaying the coarse pixel.

8. The video system of claim 1 wherein the spatial light modulator is configured to separately generate spatial masking patterns for each coarse pixel, the timing of patterns for different coarse pixels being different.

9. The video system of claim 1 wherein the spatial masking patterns have lower order and higher order spatial frequency components, and wherein the image processor allocates more time to the spatial masking patterns having lower order spatial frequency components and less time to the spatial masking patterns having higher order spatial frequency components.

10. The video system of claim 1 wherein the spatial masking patterns have lower order and higher order spatial frequency components, and wherein the image processor is configured to ignore at least one higher order spatial masking pattern at least once.

11. The video system of claim 10 wherein the image processor allocates more time to at least one of the non-ignored spatial masking patterns when ignoring at least one higher order spatial masking pattern.

12. The video system of claim 10 wherein the at least one higher order spatial masking pattern to be ignored is chosen by the image processor responsive to the image component for that spatial masking pattern.

13. The video system of claim 1 wherein the spatial masking patterns have lower order and higher order spatial frequency components, and wherein the image processor is configured to reduce a video data rate applied to the video system by using a subset of available image components corresponding to the lower order spatial frequency components.

14. The video system of claim 1 wherein the spatial masking patterns have lower order and higher order spatial frequency components, and in which the image components for each coarse pixel are described with bit precision determined by a quantization matrix that allocates more bits to image components associated with lower order masking patterns, and less bits to image components associated with higher order masking patterns, thereby reducing a total video data rate.

15. A method of displaying a video image, the video image being a frame of a video or a still image, the method comprising:

providing a video display having an array of M×N coarse pixels in which each coarse pixel is comprised of a set of primary color light sources for color operation, or a white light source for gray-scale operation;

providing a spatial light modulator aligned with the array of M×N coarse pixels to generate spatial masking patterns for blocking or passing light of the light sources, the spatial masking patterns having a resolution finer than the coarse pixel sizes by a factor of p;

generating, for each coarse pixel and for each color to be displayed, a sequence of Walsh function orthogonal image components ($D^c_{uv}$) where u and v are indices for the basis function, each Walsh orthogonal function only having a value of −1 or +1, each image component being determined from the video image information ($f^c(x,y)$) and a corresponding masking pattern of the sequence of masking patterns corresponding to the Walsh orthogonal function image components ($D^c_{uv}$), where u and v are indices for the basis functions and x and y are the coordinates of the video image pixels;

for any image components other than $D^c_{00}$ that are negative, using the absolute value of the image component and using the inverse of the corresponding masking pattern;

correcting for each color to be displayed, the $D^c_{00}$ image component by subtracting one half the summation of all $D^c_{uv}$ for the respective color, controlling the spatial light modulator to generate a sequence of spatial masking patterns for each coarse pixel, and providing driving information for the light source or light sources for each color to be displayed in each of the M×N coarse pixels corresponding to the sequence of image components ($D^c_{uv}$) for the respective color, so that the light source or light sources is/are driven with the light strength proportional to an image component ($D^c_{uv}$)while the corresponding masking pattern is illuminated;

whereby the video image is displayed at a resolution up to p times finer than the M×N coarse pixels.

16. The method of claim 15 wherein the light sources are primary color solid state light sources.

17. The method of claim 16 wherein the primary color solid state light sources are red, green and blue LED light sources.

18. The method of claim 15 wherein an active or passive matrix liquid crystal spatial light modulator is used.

19. The method of claim 15 wherein the same spatial masking patterns for all coarse pixels are simultaneously generated.

20. The method of claim 15 wherein the same spatial masking patterns are simultaneously generated for an array of multiple coarse pixels, the array of multiple coarse pixels being a sub-array of the array of M×N coarse pixels, whereby timing of the spatial masking patterns will be simultaneous for each coarse pixel within any one sub-array, but the timing of each pattern within different sub-arrays is different.

21. The method of claim 20 in which the number of image components to be used to reproduce an image for any given coarse pixel is dynamically determined through the use of certain thresholds below which the component is discarded when displaying the subarray.

22. The method of claim 15 wherein spatial masking patterns for each coarse pixel are separately generated, the timing of each pattern for different coarse pixels being different.

23. The method of claim 15 wherein the spatial masking patterns have lower order and higher order spatial frequency components, and wherein more time is allocated to the spatial masking patterns having lower order spatial frequency components and less time to the spatial masking patterns having higher order spatial frequency component.

24. The method of claim 15 wherein the spatial masking patterns have lower order and higher order spatial frequency components, and wherein at least one higher order spatial masking pattern is ignored at least once.

25. The method of claim 24 wherein more time is allocated to at least one of the non-ignored spatial masking patterns when ignoring at least one higher order spatial masking pattern.

26. The method of claim 24 wherein the at least one higher order spatial masking pattern to be ignored is chosen responsive to the image component for that spatial masking pattern.

27. The method of claim 15 wherein the spatial masking patterns have lower order and higher order spatial frequency components, and wherein the video data rate is reduced by using a subset of available image components corresponding to the lower order spatial frequency components.

28. The method of claim 15 wherein the spatial masking patterns have lower order and higher order spatial frequency components, and in which the image components for each coarse pixel are described with bit precision determined by a quantization matrix that allocates more bits to image components associated with lower order masking patterns, and less bits to image components associated with higher order masking patterns, thereby reducing a total video data rate.

* * * * *